US006185889B1

(12) United States Patent
Gilgan et al.

(10) Patent No.: US 6,185,889 B1
(45) Date of Patent: Feb. 13, 2001

(54) FLAT STYLE ROOF DRAINAGE SYSTEM AND LOW POINT COLUMN HEAD

(76) Inventors: Dan P. Gilgan, 584 Old Tennessee Hwy., White, GA (US) 30184; Jerry F. Gilgan, 200 Linda Ln., Powder Springs, GA (US) 30127; Bobby J. Lowery, 316 Mansfield Rd., White, GA (US) 30184

( * ) Notice: Under 35 U.S.C. 154(b), the term of this patent shall be extended for 0 days.

(21) Appl. No.: 09/248,642

(22) Filed: Feb. 11, 1999

(51) Int. Cl.[7] ..... E04D 13/00; E04B 1/00

(52) U.S. Cl. ..... 52/302.1; 52/11; 52/16; 52/408; 52/405; 52/199; 52/13

(58) Field of Search ..... 52/408, 199, 11

(56) References Cited

U.S. PATENT DOCUMENTS 4,014,145 * 3/1977 Groves ..... 52/199
4,530,193 * 7/1985 Ochs ..... 52/408
4,837,987 * 6/1989 Fender ..... 52/11
5,144,782 * 9/1992 Paquette et al. ..... 52/408

* cited by examiner

*Primary Examiner*—Carl D. Friedman
*Assistant Examiner*—Chi Q. Nguyen
(74) *Attorney, Agent, or Firm*—Eric R. Katz

(57) ABSTRACT

A flat roof drainage system is disclosed which utilizes a low point column head which allows the roof to be drained at the center of a structural member located at the low point of the roof. More specifically, the low point column head is a structural extension of a building column and is adapted to permit the attachment of support beams at the column head as well as the placement of a roof drain at the center of the column head so that the roof drain can be place directly at the lowest area of the roof to eliminate standing water.

20 Claims, 5 Drawing Sheets

FLAT STYLE ROOF DRAINAGE SYSTEM AND LOW POINT COLUMN HEAD

BACKGROUND OF THE INVENTION

1. Field of the Invention

The present invention generally relates to a flat roof drainage system utilizing a low point column head which allows the roof to be drained at the center of a structural member located at the low point of the roof, and more particularly, to such a flat roof drainage system utilizing a load-bearing, low point column head which is a structural extension of a building column and is adapted to permit the attachment of support beams at the column head as well as the placement of a roof drain at the center of the column head so that the roof drain can be place directly at the lowest area of the roof to eliminate standing water.

2. Background Discussion

The flat style roof is fairly common roof style used, for example, by large commercial buildings such as warehouses and the like. One particular disadvantage of the flat roof is the difficulty in obtaining good drainage since the roof is not sloping or only gently sloping and there is a tendency for water to pool and puddle. In particular, problems have been experienced regarding situating a drain at the lowest point or area of the roof because a structural column of the building is typically positioned at the lowest point of the roof and prevents providing a drain at such a location. Prior art approaches to address this problem are known.

For example, U.S. Pat. No. 5,144,782 to Paquette et al. discloses a double roof drainage system for flat roofs which employs self-draining insulating panels which direct the flow of rainwater to a centrally located drain hole. However, in contradistinction to the present invention, the drain is supported by the roof insulating panels and not by a load-bearing column. Moreover, the benefit of using low point column head to create the slope of the roof is not taught or suggested by Paquette et al., but rather, Paquette et al. use expensive insulating panels to create a slope on the flat roof to facilitate drainage toward the drain hole.

Similarly, U.S. Pat. No. 4,530,193 to Ochs discloses a built-up roof structure which creates an inwardly sloping roof at which a drain is located. However, as with the Paquette et al. patent noted above, Ochs fails to disclose the provision of a load-bearing column adapted to permit placement of the roof drain directly at the low point of the roof or the benefit of using a low point, load-bearing column head to create a roof sloped natural toward the drain in all directions.

U.S. Pat. No. 4,014,145 to Groves discloses a saddle roof employing sets of panels of fiberboard or mineral board which are disposed at predetermined positions to form a roof sloped toward a centrally located drain. However, as with the patent noted above, Groves fails to teach or suggest the provision of a load-bearing column adapted to permit placement of the roof drain directly at the low point of the roof or the benefit of using a low point column head to create a roof sloped naturally toward the drain.

The above-noted prior art approaches are expensive and time consuming to install. In addition, these arrangements require the addition of unnecessary structure to the roof surface which adds weight thereby increases the strength requirements of the supporting structure of the roof.

Moreover, none of the prior art drainage arrangements discussed above a permit a drain to be placed at the center of a structural member located at the lowest point of the roof. In addition, none of the prior art roof drainage systems teach or suggest utilizing a load-bearing, low point column head, which is a structural extension of a building column positioned at the lowest point or area of the roof, the column head being adapted to permit the attachment of support beams at the column head as well as the placement of a roof drain at the center of the column head so that the roof drain can be place directly at the lowest area of the roof to eliminate standing water.

SUMMARY OF THE INVENTION

Accordingly, it is an object of the present invention to provide a roof drainage system which allows the roof to be drained at the center of a structural member having load-bearing capabilities.

Another object of the present invention is to provide a roof drainage system for a flat roof which utilizes a load-bearing, low point column head located at a low point of the roof and adapted to permit the attachment of support beams at the column head as well as the placement of a roof drain at the center of the column head so that the roof drain can be place directly at the low point of the roof to eliminate standing water by creating a roof decking sloped to drain runoff from all directions toward the drain.

A further object of the present invention is to provide a load-bearing, low point column head which is adapted to permit the placement of a roof drain at the center of the column head so that the roof drain can be place directly at a low point or area of a flat style roof.

These and other advantageous features of the present invention are achieved by a roof drainage system for a flat style roof having a periphery, the roof drainage system comprising a structural column having a top end positioned lower than the periphery of the roof; a load-bearing column head at the top end of the structural column which is positioned below the periphery of the roof, the load-bearing column head being adapted to permit attachment of roof support beams thereto and the placement of a roof drain at a center of the load-bearing column head; and roof decking supported by the roof support beams and sloped to drain from all directions toward the roof drain which is positioned directly at a low point on the roof to eliminate standing water from pooling on the roof.

According to a further embodiment of the roof drainage system of the present invention, in a valley situation, i.e., where a plurality of low point column heads are aligned and create a valley, the roof drainage system also includes the provision of raised and sloped, tapered insulation panels which are applied to the roof decking to overlie the valley and cause rain runoff to drain from two directions so that the water is pushed from between the drains by the tapered insulation.

BRIEF DESCRIPTION OF THE DRAWINGS

FIGS. 4A–4E illustrate the structure and construction of the low point column head of the present invention.

DETAILED DESCRIPTION OF THE PREFERRED EMBODIMENT(S)

Figure 1:
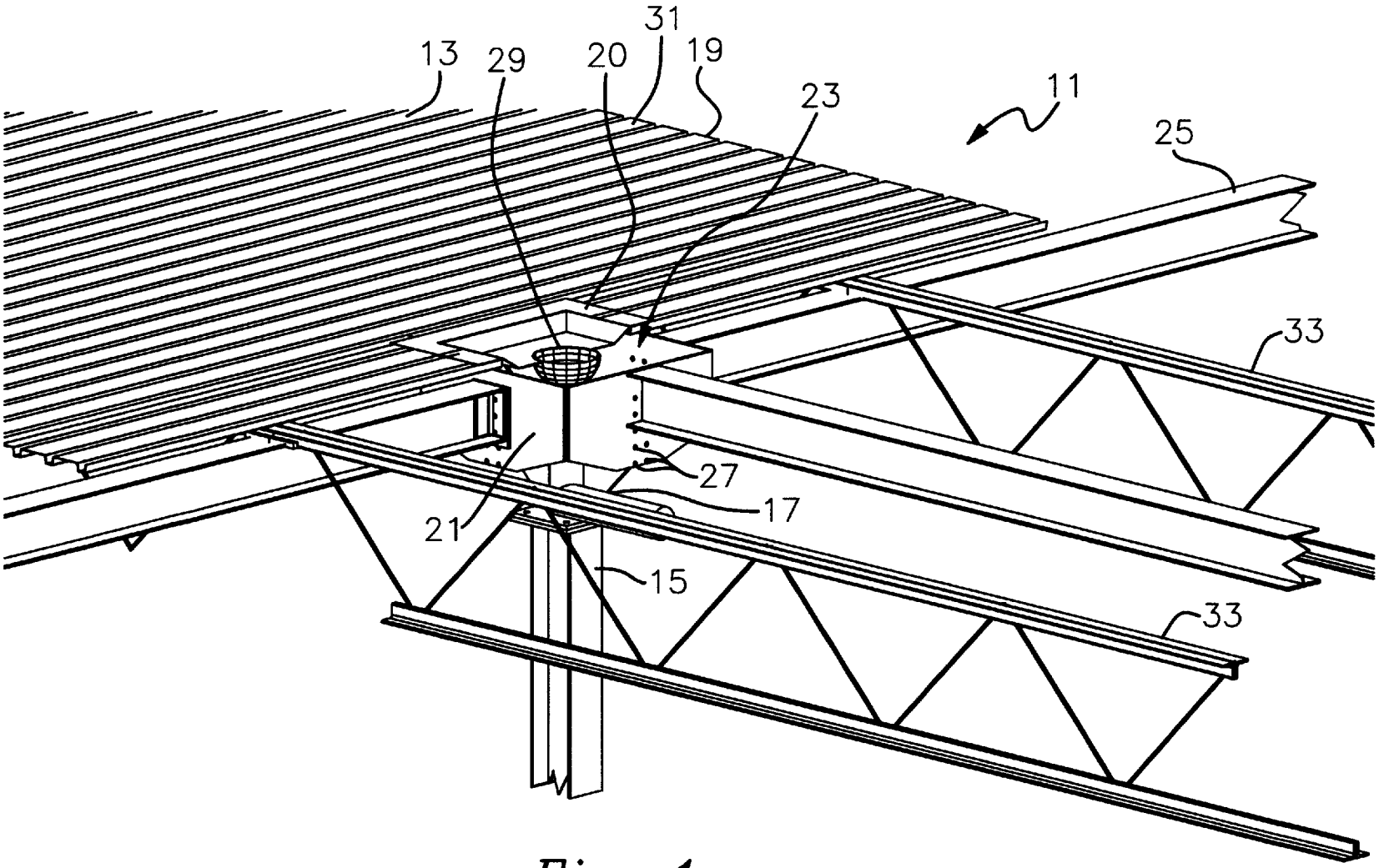
FIG. 1 is a perspective view, partially in section, illustrating one embodiment of the roof drainage system for a flat style roof of the present invention.

Referring to FIG. 1, one embodiment of a roof drainage system, generally indicated at 11, for a flat style roof 13, is illustrated in accordance with the present invention. The system 11 utilize a load-bearing column head, generally indicated at 21, which is a structural extension of a building column located at a low point or area of the roof 13 which allows a roof drain 29 to be placed directly at the low point on the roof 13.

The column head 21 is a structural member of the roof 13, with load bearing capabilities the same as the rest of the structural members supporting the roof 13, and allows the roof 13 to be drained at the center of the column head 21. To accomplish the positioning of a drain 29 at the center of the column head 21, the column head 21 is provided with an open top end facing the roof 13 and an open bottom adjacent the top of a structural column 15.

As shown in FIG. 1, the flat roof 13 is supported by at least one structural member or column 15 having a top end 17 which is positioned lower than the height of the periphery 19 of the roof 13. In the embodiment illustrated by FIG. 1, the structural column 15 is located along the longitudinal center line of the flat roof 13, however, it should be understood by those skilled in the art that the at least one structural column 15 can be located at any position or at a plurality of positions relative to the periphery 19 of the roof 13, including non-central position(s).

The load-bearing column head 21 is attached at the top end 17 of the structural column 15, and positioned below the height of the periphery 19 of the roof 13 to create a low point or area of the roof 13. The load-bearing column head 21 has an attachment arrangement, generally indicated at 23, for attaching roof support beams 25 to the column head 21. In the embodiment illustrated by FIG. 1, the arrangement 23 comprises a dual series of holes 27 which are used to attach the roof support beams 25 to the column head 21 by means of bolts, rivets or other suitable fasteners as are known in the construction industry and the like.

A roof drain 29 is positioned at the center of the load-bearing column head 21, as will be more fully explained below, and the roof support beams 25 are attached to the load-bearing column head 21 and gently sloped toward the load-bearing column head 21 so that the center of the column head 21 is located at a low point of the flat roof 13. Roof decking 31, placed over trusses 33 supported by the roof support beams 25, is accordingly sloped to drain from all directions toward the roof drain 29 which is positioned directly at the low point of the roof 13, i.e., at the center of the column head 21, to eliminate standing water from pooling on the roof.

Figure 2:
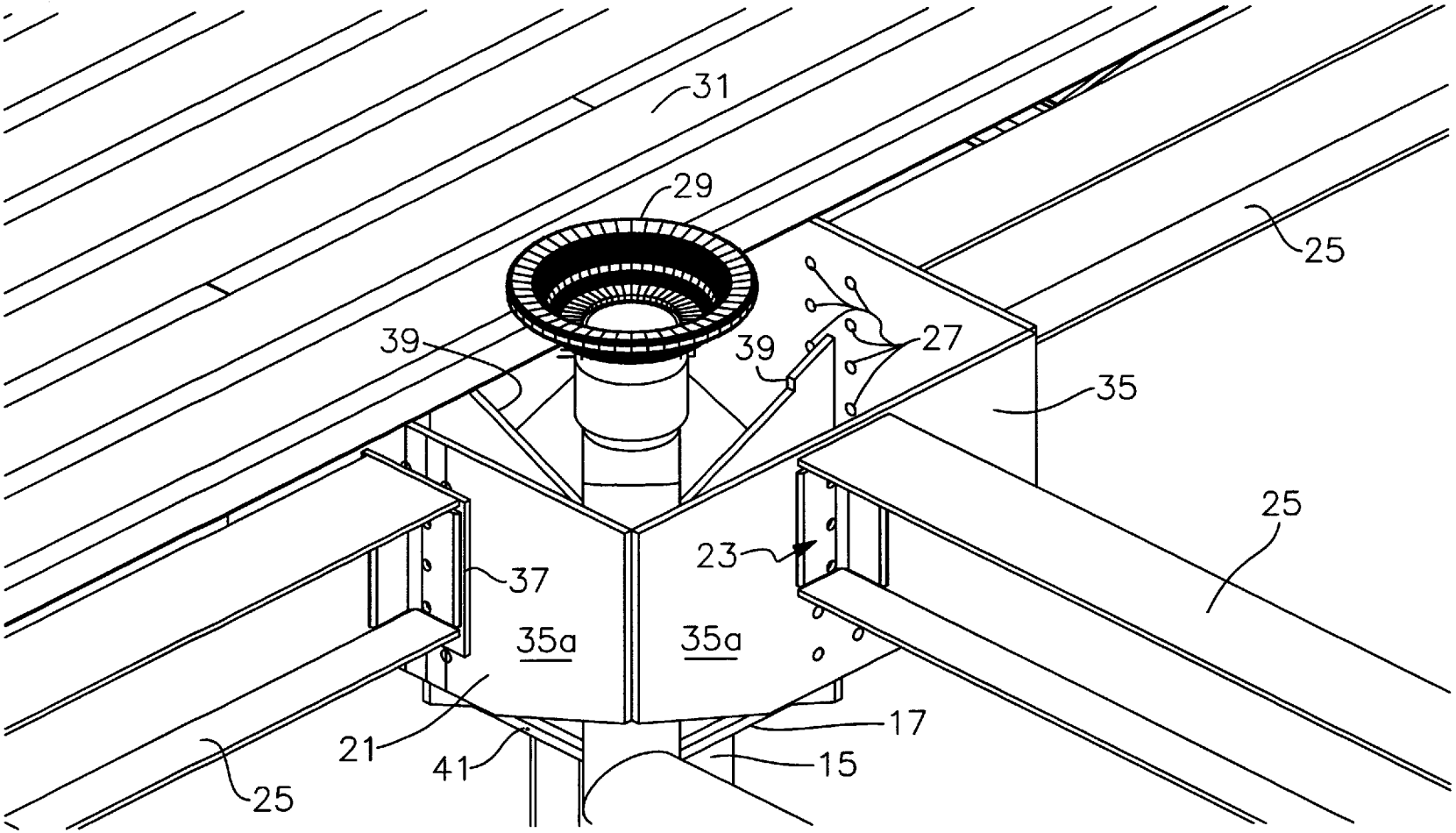
FIG. 2 is a perspective, more detailed view, partially in section, of the low point column head illustrated by FIG. 1.

Referring to FIG. 2, a more detailed perspective view of the load-bearing column head 21 is illustrated. As shown by FIG. 2, the drain 29 is attached to and supported by the roof decking 31 above the center of the load bearing column head 21. In this regard, the attachment of the drain 29 to the roof decking 31 is conventional in form, for example, by means of bolts, rivets or fasteners. Alternatively, the drain 29 is attached to or formed integral with a pan 20, as best seen in FIG. 1, which is then attached to the roof 13 in a conventional manner.

Figure 3:
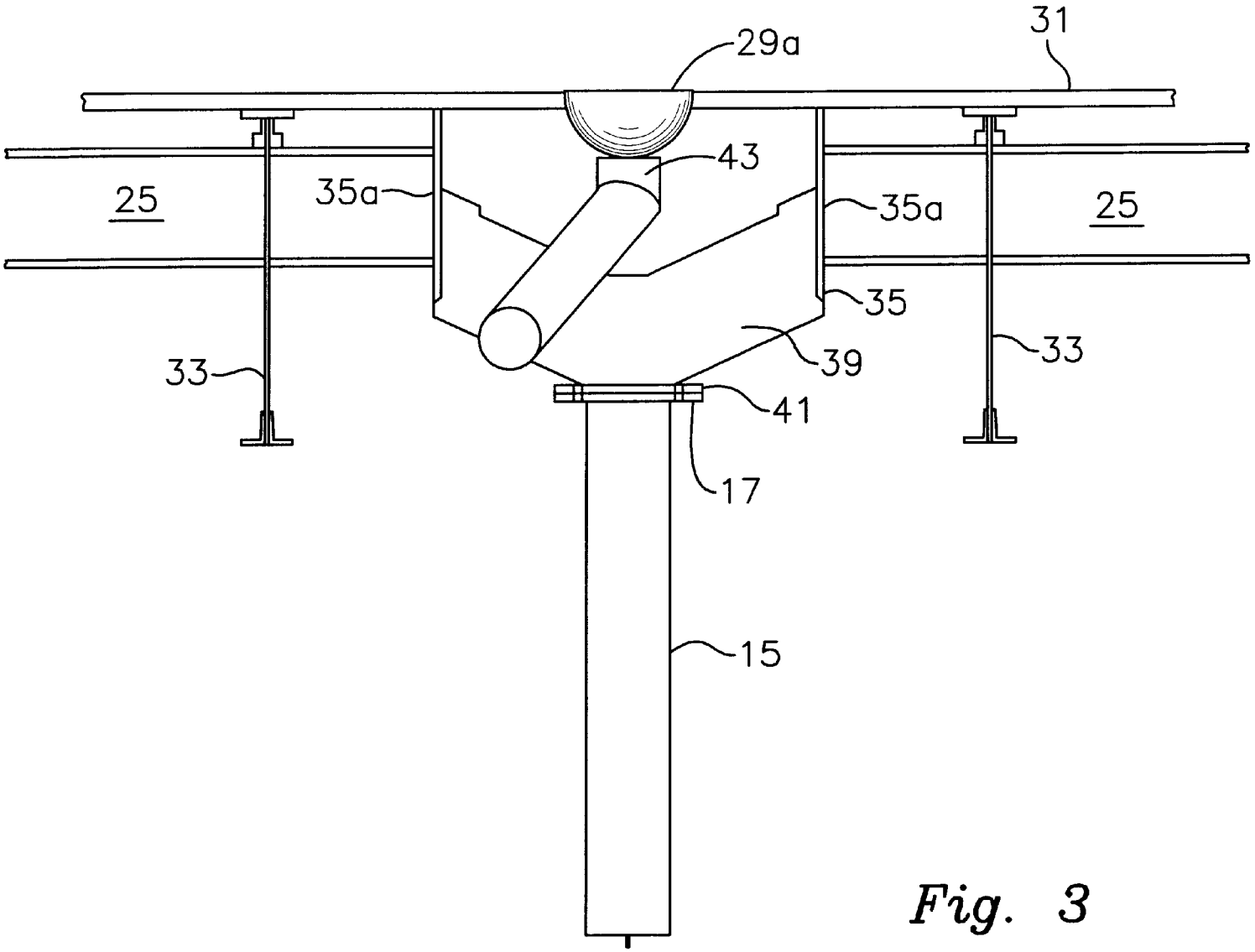
FIG. 3 is a side, planar view of the flat style roof drainage system of FIG. 1.

As best seen in FIGS. 2 and 3, the column head 21 comprises a box 35 having an open top and an open bottom formed by sides 35*a* each having the attachment arrangement 23 (series of holes 27) for attaching the column head 21 to the roof support beams 25. An angle clip or plate 37 between the column head 21 and the end of each roof support beam 25 permits the support beams 25 to be attached to the column head 21 at a slight angle to provide a slope to the roof 13 to drain runoff from all directions toward the drain 29. Attached to the inside and sides of the box 35 are wing supports 39 which sit on a pedestal 41 for attaching the low point column head 21 to the top end 17 of the associated structural column 15.

Referring to FIG. 3, the drain 29 has a drain pipe 43 which comes straight down out of the drain bowl 29*a* of the drain 29 and then turns out at an approximately 45 degree angle to an elevation to clear the frame work of the low point column head 21 as best seen in FIGS. 1 and 2. Once clear of the column head 21, the drain pipe 43 is extended along the underside of the roof 13 in a conventional manner.

Figure 4E:
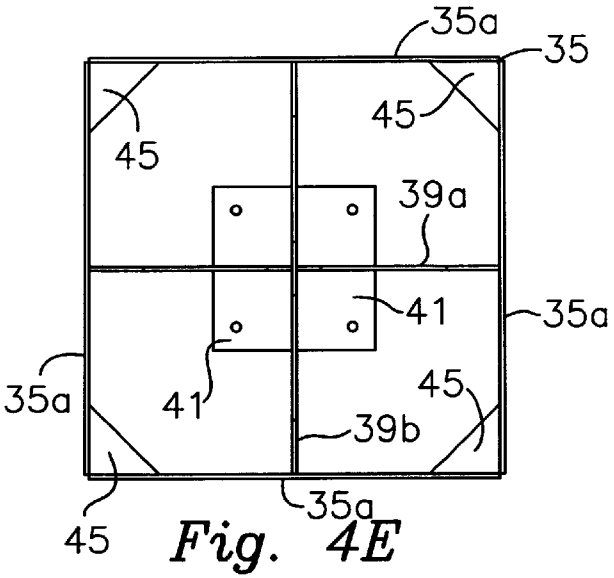

Referring to FIGS. 4A–4E, the structure and construction of the low point column head 21 are illustrated. All components of the column head 21 are made from suitable materials, such as, for example, steel plate or composite material, as will be more fully discussed hereinafter. As best seen in FIG. 4E, box 35, having an open top and bottom, is made from a plurality, for example, in the embodiment illustrated in FIGS. 4A–4E, four box plates 35*a*. It should be understood that the column head 21 of the present invention is not limited to a square, four sided bottomless box 35 as illustrated and the box 35 can be made of any number of box plates 35*a* greater than two, each box plate having equal or varying individual lengths.

The box plates 35*a* are joined to one another by suitable means, for example, by a solid weld or a stitch weld or suitable fasteners, a gusset 45 being provided in each corner to strengthen the framework of the box 35. The typical box plate 35*a,* illustrated by FIG. 4B, has notches at each of the bottom corners thereof to provide space for the drainage pipe 43 and is provided with the attachment arrangement 23, as previously discussed above, which in the embodiment illustrated, comprises a dual series of holes 27.

Figure 4D:
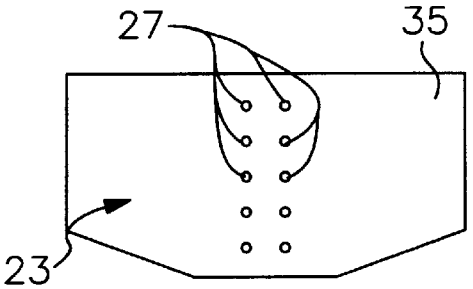

Attached to the inside the box 35 are a pair of wing supports 39*a,* 39*b.* The lower wing support 39*a,* illustrated by FIG. C, has a centrally located slot 46*a* extending from the top portion thereof and the upper wing support 39*b,* illustrated by FIG. 4D has a centrally located slot 46 extending from the bottom side thereof. The slots 46*a,* 46*b* permit the wing supports 39*a,* 39*b,* to interdigitate together to form an X-shaped interior support, as best seen in FIG. 4E which is a top view of the column head 21, the wing supports 39*a,* 39*b* being welded together for structural integrity.

Figure 4A:
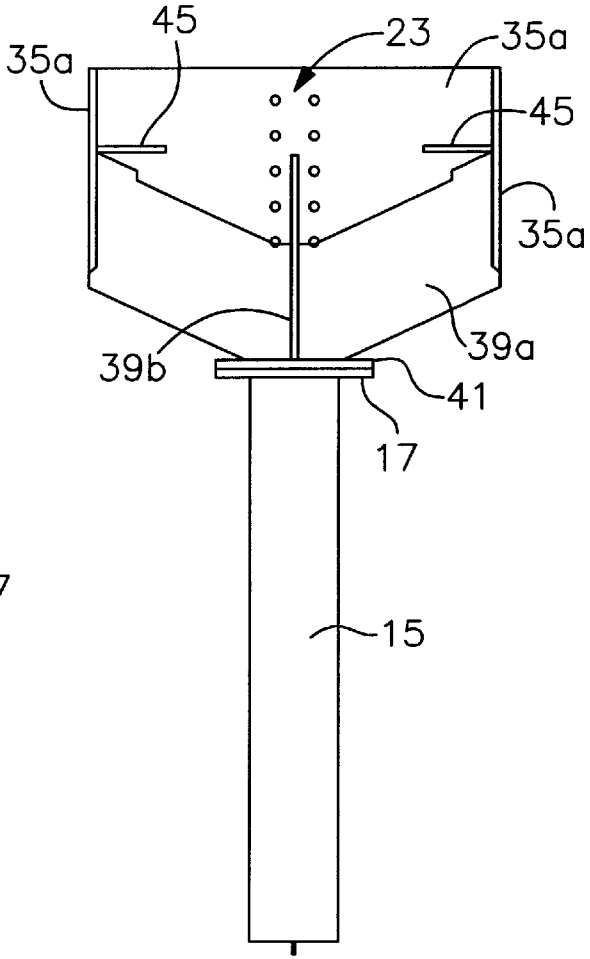
Figure 4C:
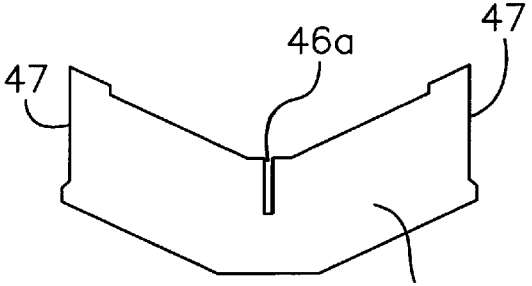
Figure 4D:
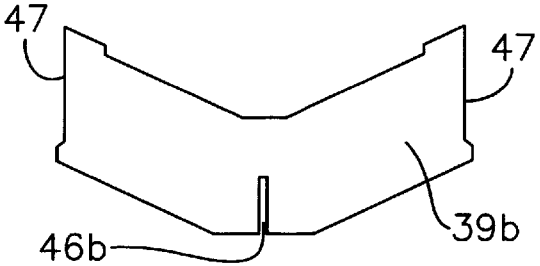

As best seen in FIGS. 4C and 4D, in order to enhance the load-bearing capability of the column head 21, the wing supports 39*a,* 39*b* have notched ends 47 on which the bottom side of each of the box plates 35*a* of the bottomless box 35 sit as best illustrated by FIG. 4A which is a front view of the column head with the front box plate 35*a* removed. The bottomless box 35 and wing supports 39*a,* 39*b* are welded together and the pedestal 41 is welded to the bottom of the wing supports 39*a,* 39*b.* In order to attach the column head 21 to the at least one structural column 15, the pedestal 41 is provided with a column head attachment arrangement at 49, for example a plurality of holes, which permits the column head 21 to be attached by means of bolts or other suitable fasteners to the top 17 of the structural column 15.

By way of example, steel plate or composite material is used as the material of the column head 21, however, the thickness of each of the components of the column head 21 can vary, depending on structural and weight considerations. Also, the size of the column head 21 can vary to accommodate different sized drains.

Figure 5:
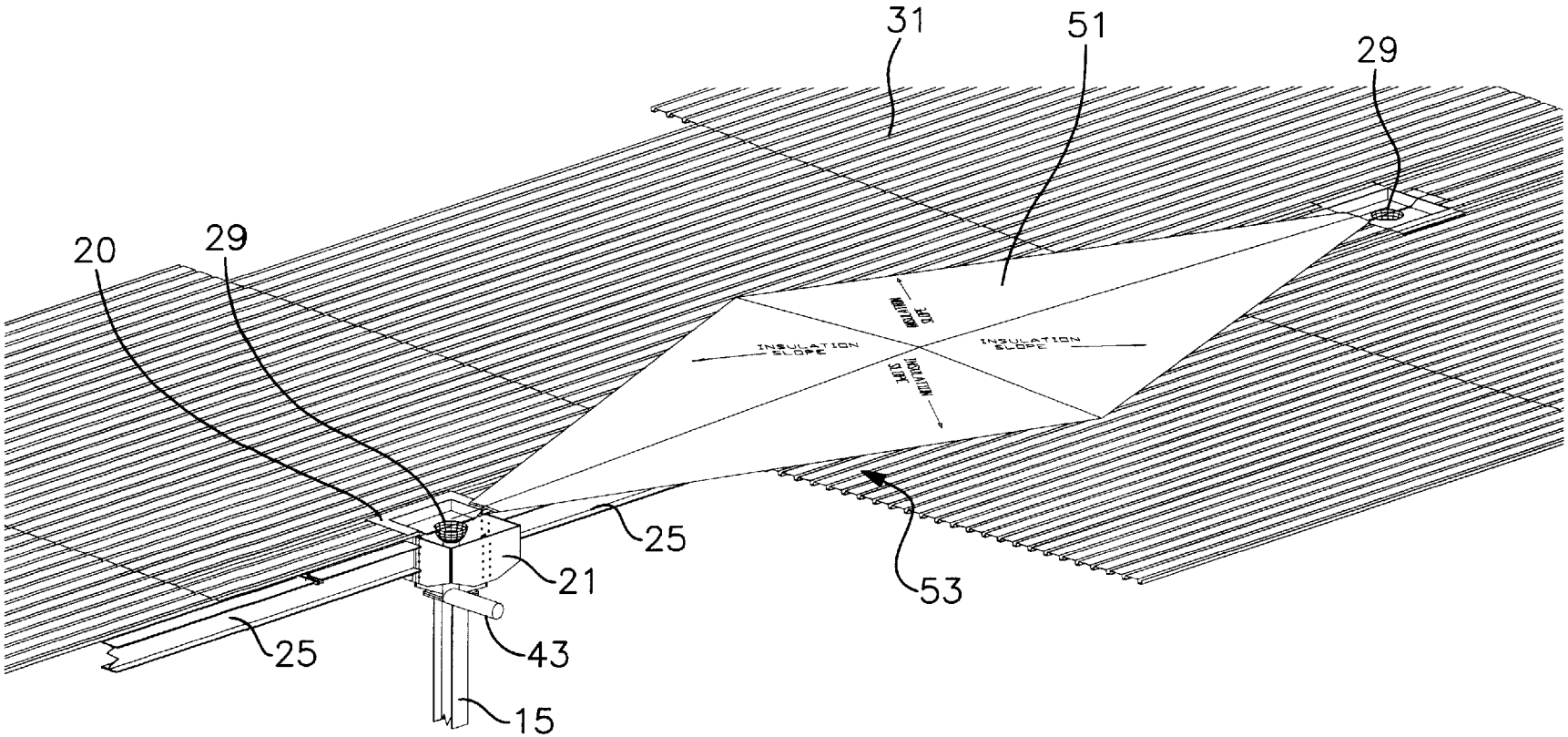
FIG. 5 is a perspective view, partially in section, illustrating a further embodiment of the roof drainage system of the present invention wherein a plurality of low point column heads create a valley situation which requires the provision of raised and sloped, tapered insulation panels to assist in the drainage of water.

As previously mentioned above, the present invention envisions the use of more than one low point column head 21. When two or more low point column heads 21 are used, a valley situation, as illustrated by FIG. 5, can arise. To address the valley situation, the roof drain system 11 also includes the provision of raised and sloped, tapered insulation panels 51 are applied to the roof decking 31 so as to overlie the valley, generally indicated at 53 and direct runoff toward the drains 29 to prevent pooling and puddles.

Although the present invention has been described with particular reference to its preferred embodiments, it should be understood that many variations and modifications will now be obvious to those skilled in that art, and it is preferred, therefore, that the scope of the invention be limited, not by the specific disclosure herein, but only by the appended claims.

What is claimed is:

1. A roof drainage system for a roof having a periphery, the roof drainage system comprising:

at least one load-bearing column head at a top of a structural column for supporting the roof, the column head being positioned below at least a portion of the periphery of the roof and having an open top end facing the roof and an open bottom adjacent the top of the structural column;

an attachment arrangement for attaching roof support beams at the column head;

a roof drain having a drain bowl positioned at the open top end of the load-bearing column head adjacent to the roof and a drain pipe leading out of the column head at the open bottom of the load-bearing column head adjacent to the top of the structural column;

roof support beams attached to the load-bearing column head which each slope toward the load-bearing column head; and roof decking placed on the roof support beams and sloped to drain from all directions toward the roof drain.

2. A roof drainage system according to claim 1, wherein the roof is a flat style roof.

3. A roof drainage system according to claim 2, wherein the load-bearing column head is positioned a low area of the flat style roof with the roof drain at the center thereof.

4. A roof drainage system according to claim 1, wherein the load-bearing column head is positioned centrally to a longitudinal axis of the structural member.

5. A roof drainage systems according to claim 4, wherein the drain bowl of the drain is positioned centrally to a longitudinal axis of the structural column.

6. A roof drainage system according to claim 1, wherein the load-bearing column head is positioned a low area of the roof with the roof drain positioned at a center thereof.

7. A roof drainage system according to claim 1, wherein the drain bowl is supported by the roof decking.

8. A roof drainage system according to claim 1, wherein the drain bowl is affixed to a pan which is supported by the roof decking.

9. A roof drainage system for a roof having a periphery, the roof drainage system comprising:

a load-bearing at a top of each of a plurality of structural columns for supporting the roof, each column head being positioned below at least a portion of the periphery of the roof and having an open top end facing the roof and an open bottom adjacent the top of the structural column;

an attachment arrangement for attaching roof support beams each of at the column head;

a roof drain having a drain bowl positioned at the open top end of each load-bearing column head and a drain pipe leading out of each column head at the open bottom thereof;

roof support beams attached to each load-bearing column head and roof decking placed on the support beams so as to create a valley on the roof; and raised and sloped, tapered insulation panels, applied to the roof decking so as to overlie the valley to direct runoff toward the drains associated to each load-bearing column head to prevent pooling and puddles.

10. A roof drainage system according to claim 9, wherein the roof is a flat style roof.

11. A roof drainage system according to claim 9, wherein the drain bowl is supported by the roof decking.

12. A roof drainage system according to claim 9, wherein the drain bowl is affixed to a pan which is supported by the roof decking.

13. A load-bearing column head for attachment at a top of a structural column for supporting a roof to permit placement of a roof drain substantially at a center of the column head, the column head comprising:

a box structure having sides and an open top and bottom;

a box support for supporting the sides of the box without enclosing the open bottom of the box structure, the support having a pedestal for attachment to the top of the structural column; and an attachment arrangement at the side for attaching roof support beams to load-bearing column head;

wherein the roof drain having a drain bowl is positioned at the open top end of the load-bearing column head adjacent to the roof and a drain pipe leads out of the column head at the open bottom of the load-bearing column head adjacent to the top of the structural column.

14. A load-bearing column head according to claim 13, wherein the sides of the box structure comprise a plurality of box plates joined to one another.

15. A load-bearing column head according to claim 14, wherein a gusset is provided in each corner of the box structure.

16. A load-bearing column head according to claim 14, wherein each box plate has notches at each bottom corner thereof to provide clearance for the drainage pipe.

17. A load-bearing column head according to claim 13 wherein the box support comprises a lower wing support having a centrally located slot extending from a top portion thereof and an upper wing support having a centrally located slot extending from a bottom side thereof, the slots permitting the lower and upper wing supports to interdigitate together to form an X-shaped interior support, each of the wing supports being welded together for structural integrity.

18. A load-bearing column head according to claim 17, wherein each of the wing supports having notched ends on which a bottom side of each of the box plates sits.

19. A load-bearing column head according to claim 13, wherein the pedestal has a column head attachment arrangement for attaching the column head to the structural column.

20. A load-bearing column head according to claim 13, wherein the column head is made of steel plate.

* * * * *